United States Patent [19]

Godwin

[11] 4,122,648

[45] Oct. 31, 1978

[54] APPARATUS FOR PLACING MASONRY MODULES

[76] Inventor: Fred D. Godwin, 2611 Trenton La., Albany, Ga. 31705

[21] Appl. No.: 804,918

[22] Filed: Jun. 9, 1977

[51] Int. Cl.[2] ..... E04F 21/00

[52] U.S. Cl. ..... 52/749; 52/747

[58] Field of Search ..... 52/749, 747, 65, 298; 425/63; 249/20; 214/6 A

[56] References Cited

U.S. PATENT DOCUMENTS

| | | | |
|---|---|---|---|
| 1,165,586 | 12/1915 | Fraser | 425/63 |
| 1,225,356 | 5/1917 | Polk | 52/749 |
| 1,736,812 | 11/1929 | Youngblood | 52/749 |
| 3,510,098 | 5/1970 | Fox | 425/63 |
| 3,521,335 | 7/1970 | Heinzle | 249/20 |

FOREIGN PATENT DOCUMENTS

| | | | |
|---|---|---|---|
| 864,146 | 1/1953 | Fed. Rep. of Germany | 425/63 |
| 131,658 | 11/1902 | Fed. Rep. of Germany | 52/298 |

*Primary Examiner*—Price C. Faw, Jr.
*Assistant Examiner*—Henry Raduazo
*Attorney, Agent, or Firm*—Newton, Hopkins & Ormsby

[57] ABSTRACT

A continuous transportation and placement frame for masonry modules, such as bricks or concrete blocks is suspended by cables from the ends of circumferentially spaced booms which radiate from a central hub. In one embodiment the hub is rigidly secured to the upper end portion of an upright rotatable standard, the lower end portion of which projects a short distance into the upper end of an upright mast. Adjacent screws tilt the standard in a self-aligning bearing fixed to the upper end of the mast. A winch on the mast extends and retracts the cables. The lower end of the mast is removably carried by a sleeve embedded in concrete in the floor of the building. Removable rods in the frame releasably support the modules.

In another embodiment, the winch is on the standard and the lower end of the standard is tiltably received in the sleeve.

15 Claims, 8 Drawing Figures

APPARATUS FOR PLACING MASONRY MODULES

BACKGROUND OF THE INVENTION

Machines for laying bricks or other masonry modules are known in the prior art in varying forms. Generally speaking, such prior art machines have not been widely accepted commercially for economic reasons. Most of the proposed machines are complex and very costly in terms of initial manufacturing and installation and dismantling on the construction site. They require frequent adjustment and are quite sensitive in terms of their abilities to place the masonry modules properly.

Some examples of the known patented prior art are contained in U.S. Patents Re: Nos. 28,305; 2,523,063; 3,231,646; 3,328,859; 3,466,883; 3,550,344 and 3,863,420.

In general, the objective of the present invention is to improve on the prior art by providing a greatly simplified and much more practical and economical apparatus for placing masonry modules, such as bricks or concrete blocks, in successive courses for the purpose of constructing building walls of any desired perimeter shape, such as circular, square or rectangular.

Among the specific features and advantages of the invention are the ease with which the apparatus may be loaded with masonry modules at one loading station, the module transport and loading frame being rotatable relative to this station; and the relative ease with which the apparatus can be set up or dismantled at the job site, in contrast to the more complex prior art.

Additional features of the invention reside in a unique and simplified system for supporting and leveling the module transport and placement frame, and the construction of this frame including the provision of withdrawable temporary support pins for the modules being carried by the frame.

Another feature of simplicity and convenience is the provision of a cable suspension system for the module placement frame and winch means for raising and lowering the frame relative to a central upstanding support mast whose angularity can be adjusted with convenience to precisely level the module placement frame.

The entire apparatus is unitized in its assembled use condition and is symmetrical around the center support mast and ground anchoring means generally in the sense of a rotary clothesline tree.

Other features and advantages of the invention over the prior art will become apparent during the course of the following description.

DETAILED DESCRIPTION

Figure 1:
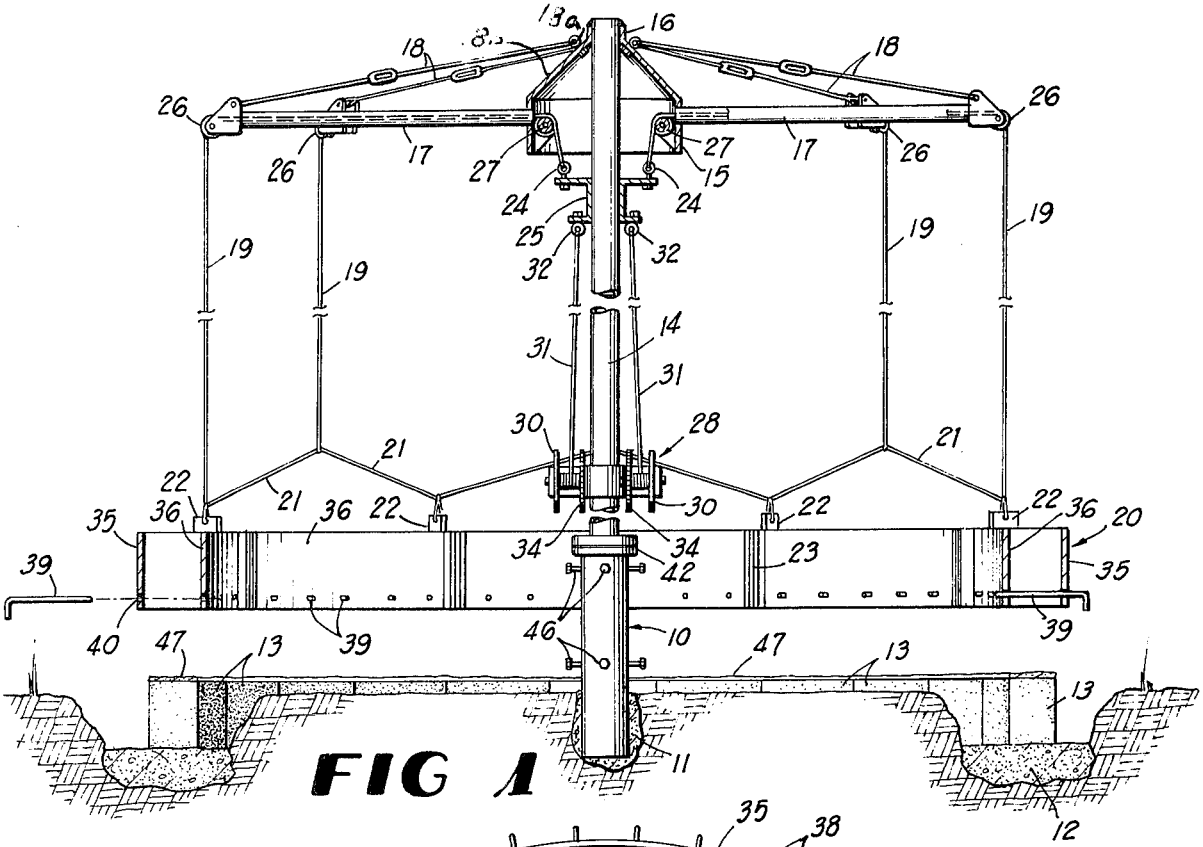
FIG. 1 is a side elevational view, partly in vertical cross section, of an apparatus for placing masonry modules embodying the invention.
Figure 2:
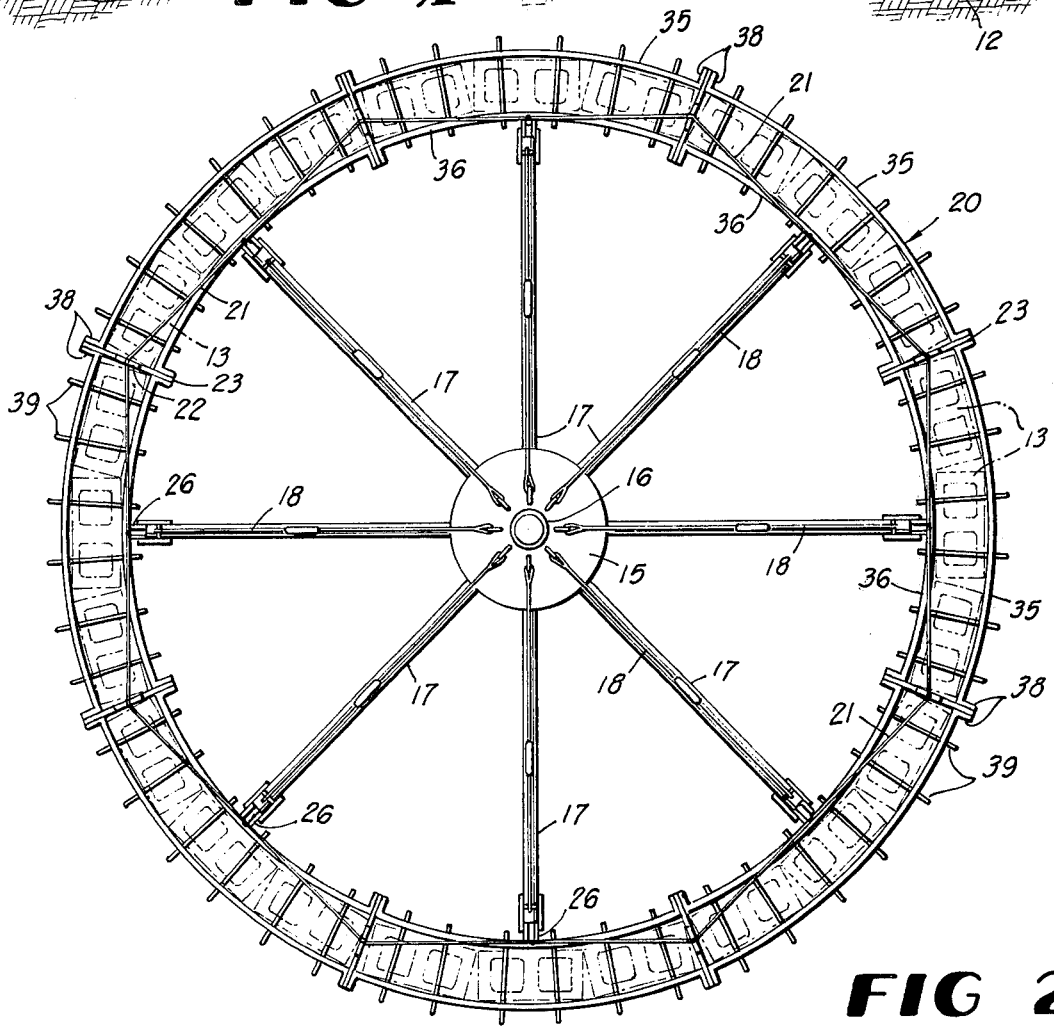
FIG. 2 is a plan view of the apparatus.
Figure 3:
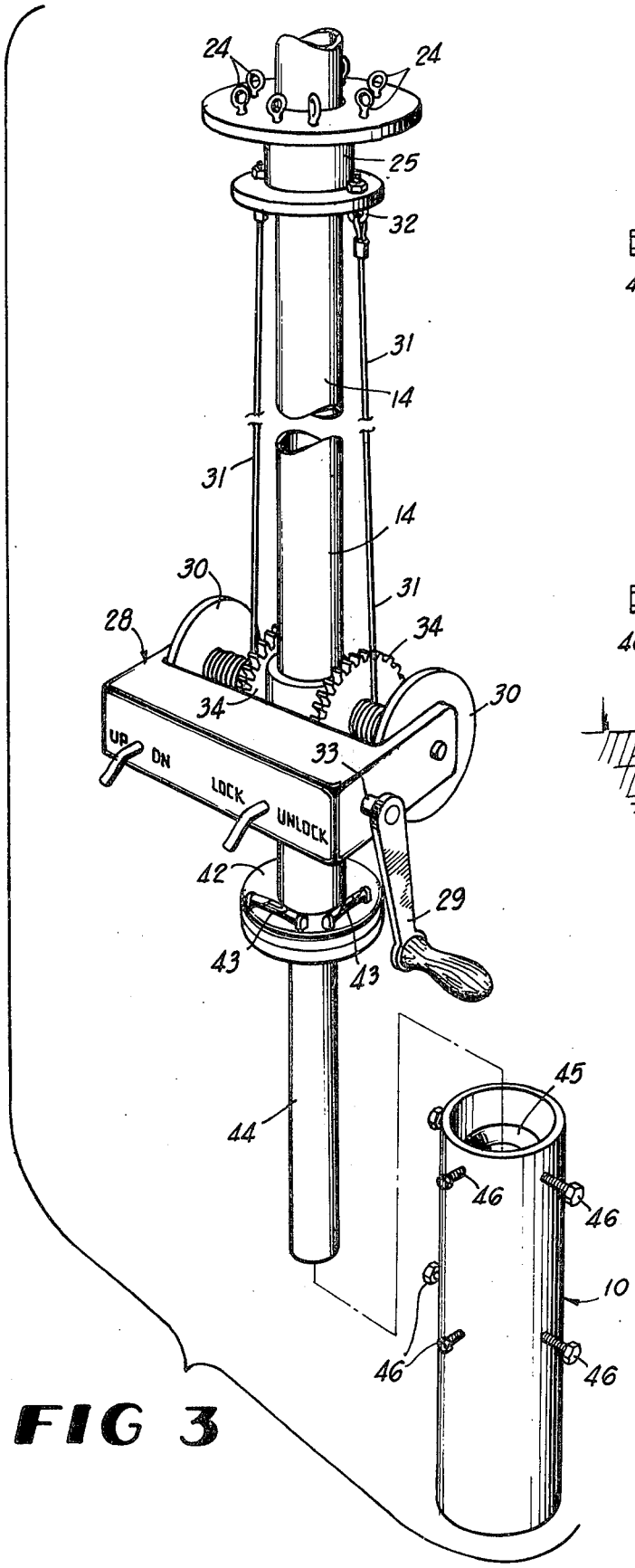
FIG. 3 is a fragmentary exploded perspective view of a center vertical support mast and anchoring means.

Referring to the drawings in detail wherein like numerals designate like parts, and directing attention first to FIGS. 1 through 5, the numeral 10 designates a vertical support sleeve for the entire apparatus which may be anchored in concrete 11 placed in a small ground excavation, so that the sleeve 10 projects well above ground level. A poured concrete foundation 12, FIG. 1, for the stable support of a building wall of any desired shape is first established. In the embodiment of the invention shown in FIGS. 1 to 5, the wall being constructed by the invention is annular. However, the apparatus is capable of constructing walls of other shapes, as will be further disclosed. FIG. 1 of the drawings also shows a first or base course of modules, such as concrete blocks 13, already set in place on the foundation 12 by the apparatus or otherwise.

The apparatus additionally comprises a vertical mast 14 constructed of hollow tubular cylindrical pipe and carrying a concentric considerably enlarged diameter hub ring 15 near its top end, including a reduced diameter upper extension 16 which may be welded to the top of the mast 14. The hub ring 15 is thus fixed to the mast 14 in spaced surrounding relation thereto.

Fixed to the hub ring 15 in circumferentailly equidistantly spaced relation are plural horizontal radial pipe booms 17. These pipe booms 17 are further supported on the vertical mast 14 by turnbuckle guy rods 18 connected by eyelets **18*a* to a skirt 18*b* on the upper end of standard 9. The pipe booms 17 receive therethrough suspension cables 19 for a masonry module transport and placement frame 20, to be fully described. The distal ends of suspension cables 19 are connected to harness cables 21, the ends of which, in turn, are secured to upstanding apertured lugs 22 on the tops of radial vertical connector plates 23 of the frame 20**.

The proximal ends of the suspension cables 19 are secured to eye bolts 24 on the upper end of a vertical axis guide sleeve 25 which is slidably engaged with the mast 14 and movable therealong. The cables 19 are trained over guide sheaves 26 at the outer or proximal ends of booms 17 and over additional sheaves 27 inside of the hub ring 15, the cables 19 passing through the hollow portions of booms 17 and through holes in ring 15.

For raising and lowering the frame 20 on the mast 14 a simple winch 28 having a hand crank 29 or motor means, if preferred, is fixedly secured to the mast 14 at a convenient elevation above ground level and above the support sleeve 10. The winch 28 has two interconnected spools 30 for cables 31 which have corresponding ends secured to eye bolts 32 on the lower flange of guide sleeve 25. Thus, by paying out the cables 31 from the spools 30 simultaneously, the guide sleeve 25 slides upwardly on the mast 14 and the placement frame 20 is lowered. When the cables 31 are reeled in, the sleeve 25 is pulled downwardly on the mast 14, and the frame 20 is elevated. The arrangement is simple and very reliable. The mechanism of the winch 28 is conventional and need not be described in full detail. Pinion gears, not shown, on the shaft 33 of hand crank 29 mesh with gears 34 of the spools 30 to drive the latter in unison.

Figure 5:
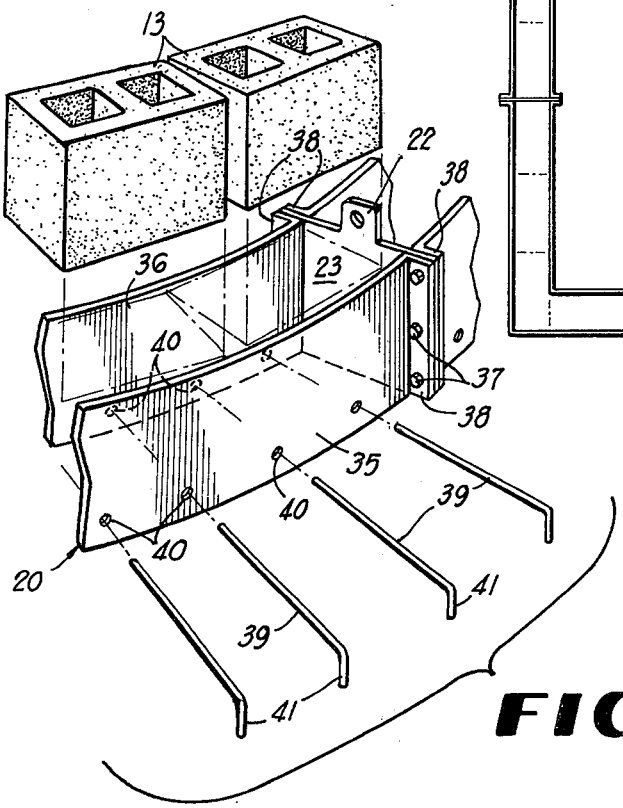
FIG. 5 is a fragmentary exploded perspective view of the transport and placement frame for masonry modules.

The frame 20, is a trough-like upwardly opening member, which is annular in the embodiment shown in FIGS. 1 to 5, is formed in spaced concentric vertical side wall segments 35 and 35, and these segments or sections are rigidly joined at circumferentailly equidistantly spaced points around the annular frame by the vertical radial connector plates 23 or partitions, already noted, see FIG. 5. The connector plates 23 are secured by bolts 37 to side flanges 38 on the arcuate side wall segments 35 and 36. When thus assembled, the masonry module transport and placement frame 20 is rigid and unitary. It can be easily disassembled for storage and transport.

Temporary support means for the modules 13 placed in the frame 20 between the side wall segments 35 and 36 is provided in the form of a plurality of horizontal radial rods 39 received removably within radial apertures 40 near and above the bottom edges of the frame side walls. The rods 39 have handle extensions 41 at their outer ends which facilitate pulling the support rods out of the frame 20 when the course of building modules therein has been laid or placed by the apparatus on the next underlying course in the construction of a wall.

A further important feature of the invention is the provision of a reliable and simplified means for adjusting the angle of the mast 14 in all vertical planes to level accurately the frame 20. This means is in the form of the self-aligning thrust bearing 42 rigidly secured to the bottom of the mast 14 and resting freely on the top end of support sleeve 10. Leveling gauges 43 may be provided directly on the thrust bearing 42. A reduced diameter shaft extension 44 depends from the thrust bearing 42 and is rigidly secured thereto. This shaft extension extends well into the interior of anchored sleeve 10 and is engaged by adjusting bearing segments 45 at two vertically spaced elevations near the top and bottom of the shaft extension 44 for stability. Comparatively large diameter frame 20 are quite easily rotated relative to fixed loading points for the modules 13 so that a workman at one or two loading points can fill half or the entire frame with modules very conveniently. Preferably two persons load the frame 20 from diametrically opposed positions to prevent unbalancing the load.

Figure 4:
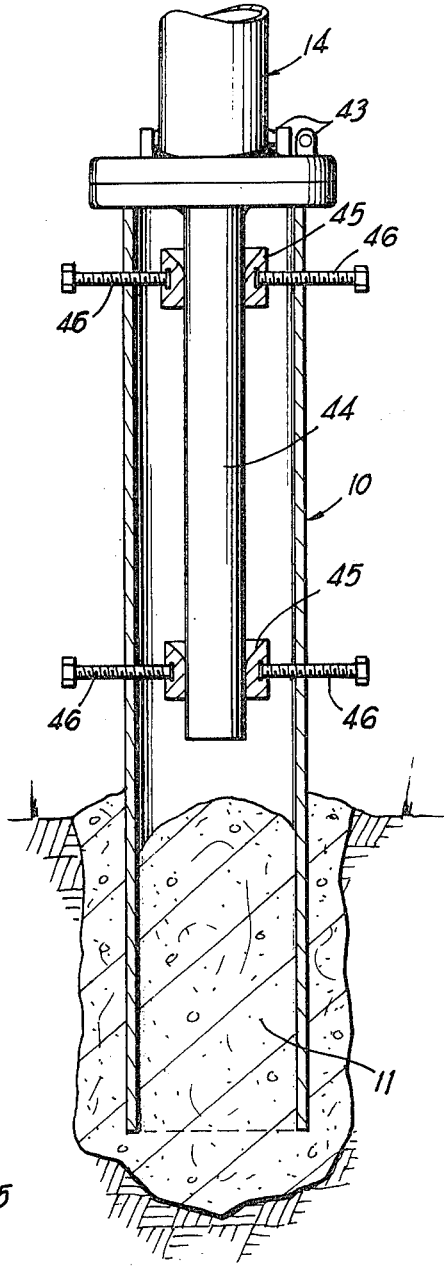
FIG. 4 is an enlarged central vertical cross section through the mast anchoring and support sleeve and also showing mast angle adjusting means.
Figure 4A:
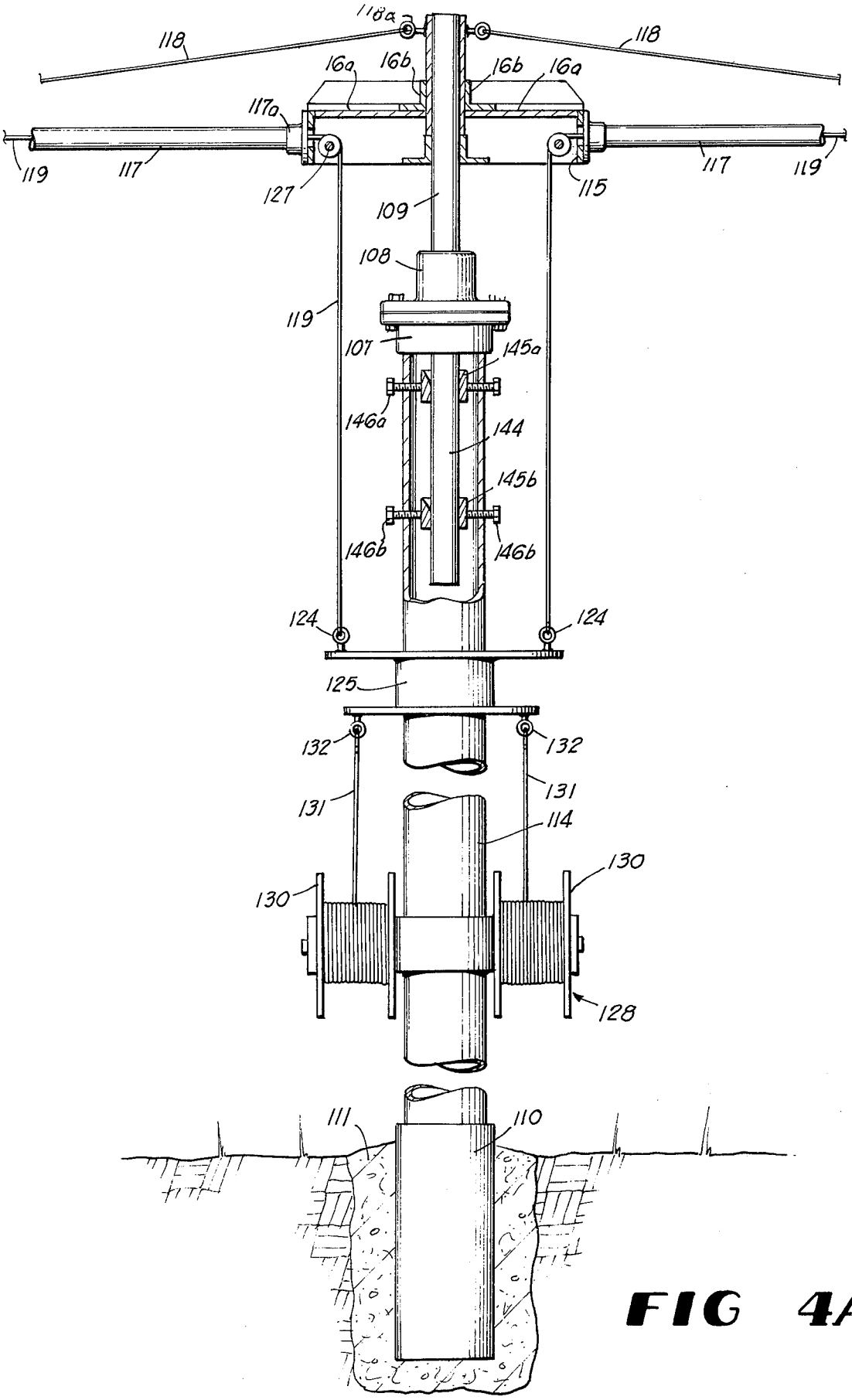
FIG. 4A is a partially broken away side elevational view of a modified form of the present invention.

In FIG. 4A a second embodiment is disclosed wherein the tilt adjustment assembly is toward the upper portionof the machine. In this embodiment a mast or pipe 114 has a lower end portion removably received in an upright sleeve 110 so that its lower end rests upon concrete 111 which received sleeve 110. The upper end of mast 114 extends well above the height of the wall intended to be built, the upper end of mast 114 being provided with a butt flange 107 which carries a self-aligning thrust bearing 108 secured thereto, the bearing 108 being coaxially aligned with the mast 14. A supporting upright cylindrical standard 109 projects through and is supported solely by the bearing 108, the lower portion 114 of standard 109 being of substantially smaller diameter than mast 114 and being received within the upper end portion of mast 114. The upper end portion of standard 109 forms a rotatable extension of mast 114 and projects above bearing 108 so as to carry, by their central portions, a plurality of tangentially mounted circumferentially spaced opposed pairs of horizontally extending ring supporting struts 116*a* and 116*b*. An enlarged diameter annular hub ring 115 is carried by the ends of struts 116*a* and 116*b* in concentric relationship to standard 109.

The outer periphery of ring 115 is provided with a plurality of circumferential equally spaced internally threaded pipe couplings 117*a* which respectively threadedly receive the inner ends of a like number of horizontally disposed, hollow cylindrical booms 117 which radiate from hub ring 115.

As a means for incrementally adjusting the tilt, i.e. angle, of the upstanding standard 109, the mast 114, at its upper end portion is provided with a plurality of circumferentially spaced upper set screws 146*a*, the inner ends of which carry an annular bearing 145*a* within the hollow portion of mast 114. Corresponding lower set screws 146*b* carry a lower annular bearing 145*b* spaced below bearing 145*a* in mast 114. The bearings 145*a*, 145*b* removably receive the lower extension or end portion 144 of standard 109. By manipulation of set screws 46*a*, 46*b*, the standard 109 will be tilted within the self-aligning thrust bearing 108 which carries the weight. The embodiment of FIG. 4A includes the harness cables 119 extending over pulleys or sheaves 127 and secured to eye bolts 124 on guide sleeve 125 all in the manner of the preceeding embodiment. The sleeve 125 is, however, slidably carried by mast 114, being pulled downwardly or released upwardly by cables 131 on spools 130 of winch 128. Cables 131 are secured by eye bolts 132 to guide sleeve 125 as illustrated.

Turnbuckle wires 118 support the booms 117 from eyelets 118 in a manner similar to that illustrated for the preceeding embodiment.

The embodiment of FIG. 4A is otherwise identical to the preceeding embodiment.

In operation, it is preferable for two men to load the frame 20, the men being stationed in fixed locations 180° from each other and outwardly adjacent the frame 20. As the upwardly open frame 20 is loaded with juxtaposed modules 13 the frame 20 is rotated through 180°, in one direction or the other, until a layer or course of modules 13 has been accumulated in the frame 20.

When the frame 20 is thus loaded, it can be manipulated as previously described by use of the winch 28, or 128, to lower the building modules 13 carried by the frame 20 down onto the top of the next underlying course. Prior to placing each course of modules with the apparatus, a suitable mortar layer 47, FIG. 1, is applied to the top of the course already in place. When the frame 20 is lowered sufficiently to set the modules 13 therein on the mortar layer 47, the module support rods 39 are left in place until the mortar sets up sufficiently to support the modules. Then the rods 39 are pulled free of the frame 20 and the frame 20 can thereafter be elevated by the cable means, leaving another course of the wall modules properly placed. The holes left in the mortar by rods 47 are subsequently filled in.

It is believed that the simplicity, convenience and efficiency of the apparatus compared to the complicated prior art can now be readily understood by those skilled in the art.

Figure 6:
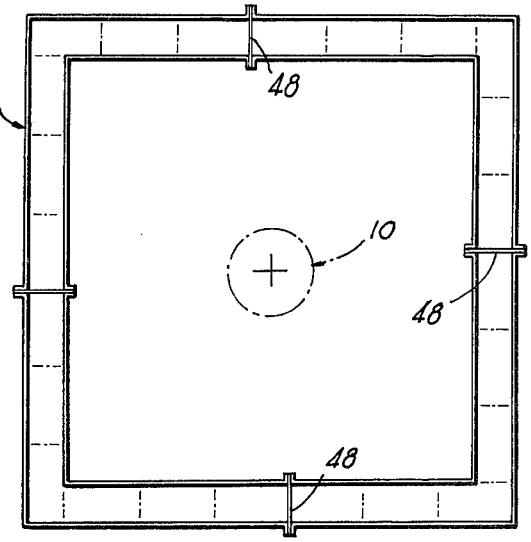
FIGS. 6 and 7 are partly schematic plan views of module transport and placement frames having other perimeter shapes.
Figure 7:
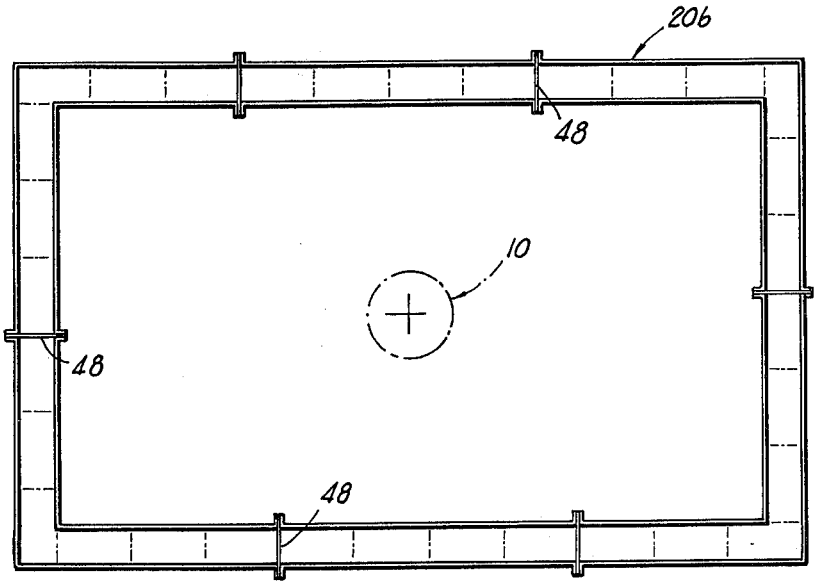

While FIGS. 1 to 5 show an apparatus for constructing an annular wall, it should be understood that the invention can also be embodied in an apparatus for constructing square, rectangular or other wall perimeter shapes, merely by changing the configuration of the frame 20. Thus, FIG. 6 depicts schematically an embodiment of the invention where the module transport and placement frame 20*a* is square in configuration. Similarly, FIG. 7 shows another embodiment where the frame 20*b* is rectangular. In both cases, the frames are formed in sections or segments having flanges connected by connector plates 48 in the same manner illustrated in FIG. 5 for the connector plates 23 or annular frame 20. In all other respects, the apparatus may be identical to the embodiment shown in FIG. 1 to 5, and the shape and size of the module placement frame may be varied to meet the needs of particular applications.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An apparatus for placing masonry modules onto a wall construction comprising a central upstanding support mast, booms carried by said mast near the top thereof and extending outwardly therefrom, suspension cable means movably carried by said booms, means for taking in and paying out said suspension cable means, a masonry module transport and placement frame of trough-like form suspended horizontally about said mast by said cable suspension means from said booms, and movable masonry support elements carried by said frame for supporting said masonry modules when the modules are disposed within said frame and when said support elements are in prescribed positions in said frame, said support elements being movable from their prescribed positions to positions for releasing said masonry modules from said frame.

2. The apparatus defined in claim 1 wherein said placement frame includes a pair of opposed spaced side wall segments which received, therebetween, said masonry modules, and wherein said support elements extend between the bottom portions of said side wall segments.

3. The apparatus defined in claim 1 wherein said frame is a continuous frame which extends around said mast and wherein said frame is rotatable with respect to said mast so that masonry modules may be loaded in said frame successively from a single position as said frame is rotated about said mast.

4. The apparatus defined in claim 1 in which said booms extend radially from said mast and wherein said frame includes side wall segments which are disposed concentrically around said mast, said segments being joined together, end to end, to form a continuous trough for the receipt of said masonry modules and wherein said support elements extend between the bottom portions of said side wall segments.

5. The apparatus defined in claim 4 wherein said side wall segments include inner and outer segments provided with end flanges and including connector plates disposed between the flanges of adjacent side wall segments, said connector plates being suspended from said cable means.

6. The apparatus defined in claim 1 wherein said means for taking in and paying out the suspension cable means includes a winch disposed on said mast.

7. The apparatus defined in claim 1 wherein said frame includes inner and outer side walls surrounding said mast and wherein said support means includes a plurality of circumferentially spaced rods projecting radially through said side walls, said rods providing the sole support for the modules which are disposed within said frame.

8. An apparatus as defined in claim 1, and means connected with said mast to adjust the angularity thereof in all vertical planes for the purpose of leveling said frame.

9. An apparatus as defined in claim 8, and said means to adjust the angularity of said mast comprising a thrust bearing on the mast, a shaft extension on the mast projecting below the thrust bearing, a support sleeve for the mast adapted to be anchored in the ground and projecting above ground level vertically and receiving the shaft extension of the mast within its interior with said thrust bearing of the mast resting on the upper end of said support sleeve, and mast angle adjusting devices on the support sleeve and engaging said shaft extension inside of the support sleeve.

10. An apparatus as defined in claim 9, and said mast angle adjusting devices comprising plural elevation radial adjusting screws on said support sleeve having segmental bearing elements within the support sleeve adapted for engagement with said shaft extension and being independently adjustable.

11. An apparatus as defined in claim 5, and said frame being annular and said connector plates being radially disposed.

12. An apparatus as defined in claim 5, and said frame being rectangular and continuous.

13. An apparatus as defined in claim 1, and said frame having spaced side walls and being open at its top, and said withdrawable module support elements comprising a multiplicity of rods engaged through the side walls of the frame transversely near the bottom of the frame, said side walls being apertured to receive said rods.

14. An apparatus as defined in claim 1, and said booms being tubular, a hub ring secured to the mast near the top of the mast and surrounding the mast in spaced concentric relation thereto and carrying said booms, a guide sleeve slidably mounted on said mast, said suspension cable means comprising plural suspension cables for said frame and one suspension cable extending movably through each boom and having an end connected with said guide sleeve, and said winch means including at least one cable adapted to be reeled in and payed out by the winch means and connected with said guide sleeve in opposing relation to said suspension cable.

15. An apparatus as defined in claim 14, and guide sheaves for said plural suspension cables adjacent the inner and outer ends of the tubular booms.

* * * * *